US006655271B1

(12) United States Patent
Contompasis

(10) Patent No.: US 6,655,271 B1
(45) Date of Patent: Dec. 2, 2003

(54) METHOD, SYSTEM AND APPARATUS FOR CREATING A COLORANT PATTERN IN POROUS MATERIAL

(76) Inventor: Charles E. Contompasis, 1345 Union St., Schenectady, NY (US) 12305

( * ) Notice: Subject to any disclaimer, the term of this patent is extended or adjusted under 35 U.S.C. 154(b) by 197 days.

(21) Appl. No.: 09/686,840

(22) Filed: Oct. 10, 2000

(51) Int. Cl.[7] ..... B41M 1/12
(52) U.S. Cl. ..... 101/129; 101/125; 101/126
(58) Field of Search ..... 101/114, 115, 101/124, 125, 126, 127, 127.1, 129, 128.4, 470, 424.1, 488

(56) References Cited

U.S. PATENT DOCUMENTS

| | | | | | |
|---|---|---|---|---|---|
| 3,175,488 | A | * | 3/1965 | Tillett et al. | 101/115 |
| 3,221,648 | A | * | 12/1965 | Weiss | 101/126 |
| 4,031,280 | A | * | 6/1977 | Weller et al. | 101/211 |
| 4,083,205 | A | * | 4/1978 | Clarke et al. | 101/470 |
| 4,292,394 | A | | 9/1981 | Chu et al. | 430/291 |
| 4,655,784 | A | * | 4/1987 | Rahman | 101/129 |
| 4,742,699 | A | * | 5/1988 | Nakahara et al. | 101/119 |
| 4,935,773 | A | | 6/1990 | Meacham | 355/92 |
| 5,050,498 | A | * | 9/1991 | Smith | 101/128.4 |
| 5,394,796 | A | | 3/1995 | Jones et al. | 101/129 |
| 5,596,925 | A | | 1/1997 | Hasegawa | 101/127.1 |
| 5,743,182 | A | | 4/1998 | Kobayashi et al. | 101/129 |
| 5,927,193 | A | | 7/1999 | Balz et al. | 101/129 |
| 5,937,752 | A | | 8/1999 | Uchiyama | 101/127.1 |
| 5,953,989 | A | | 9/1999 | Uchiyama et al. | 101/129 |
| 6,053,100 | A | * | 4/2000 | Uchiyama et al. | 101/127 |
| 6,080,243 | A | * | 6/2000 | Insley et al. | 15/415.1 |
| 6,253,674 | B1 | * | 7/2001 | Cook | 101/488 |
| 6,397,488 | B1 | * | 6/2002 | Brinkly | 101/424.1 |

FOREIGN PATENT DOCUMENTS

| | | | |
|---|---|---|---|
| JP | 54-56654 | * | 5/1979 |

* cited by examiner

*Primary Examiner*—Eugene H. Eickholt
(74) *Attorney, Agent, or Firm*—Wayne F. Reinke, Esq.; Heslin Rothenberg Farley & Mesiti P.C.

(57) ABSTRACT

A sealable vacuum chamber has an outlet. A template within the chamber includes flow guides for guiding colorant under vacuum across and into porous material when in contact therewith toward the outlet to create a pattern in the porous material. The flow guides allow for at least slight variation in the pattern without being altered.

46 Claims, 7 Drawing Sheets

METHOD, SYSTEM AND APPARATUS FOR CREATING A COLORANT PATTERN IN POROUS MATERIAL

BACKGROUND OF THE INVENTION

1. Technical Field

The present invention generally relates to creating colorant patterns in porous materials. More particularly, the present invention relates to creating colorant patterns in porous materials in a vacuum environment.

2. Background Information

In the past, patterns were created in porous materials, such as fabric for clothing, by hand, and by processes such as imprinting, stenciling, silk screening, dyeing, transfer, ink jet, tie dye, etc. Each has drawbacks and limitations. For example, creating fabric designs by hand (e.g., by ink application), by tie dye or by silk screening is time consuming and relatively low-volume producing. As another example, imprinting, stenciling and other similar methods place the exact same design on all the fabric created, resulting in a lack of uniqueness in the finished product, which may not be desirable for some applications. As still a further example, silk screening allows for no variation, is a relatively expensive pattern-creation technique, only allows the application of one color per screen, and lacks full penetration of colorant through fabric.

Thus, a need exists for a relatively fast, low-cost way to produce volumes of at least slightly varying, high-quality, high-penetration colorant patterns in porous material.

SUMMARY OF THE INVENTION

Briefly, the present invention satisfies the need for a relatively fast, low-cost way to produce high-quality, high-penetration colorant patterns in porous material with at least slightly varying design in volume, by using flow guides in a vacuum environment to guide multiple colorants simultaneously across and into a porous material to create a pattern with high saturation of the porous material. The guides allow for variations in pattern when repeated with another porous material.

In accordance with the above, it is an object of the present invention to provide a way to create a pattern in porous material with colorant.

The present invention provides, in a first aspect, a method of creating a colorant pattern in porous material. The method comprises guiding a colorant in a vacuum environment across and into a porous material to create a colorant pattern therein.

The present invention provides, in a second aspect, a system for creating a colorant pattern in porous material. The system comprises a sealable vacuum chamber with at least one outlet for exiting of the atmosphere, and a template with at least one colorant flow guide for guiding a colorant across and into porous material and toward the at least one outlet when in contact with the template to create a colorant pattern in the porous material.

The present invention provides, in a third aspect, apparatus for creating a colorant pattern in porous material. The apparatus comprises a template with at least one colorant flow guide for guiding colorant along the flow guide when under vacuum.

The present invention provides, in a fourth aspect, a system for creating a colorant pattern in porous material. The system comprises a sealable vacuum chamber with at least one outlet, and at least one barrier gasket for creating at least two zones in the porous material. Each of the outlets is couplable to one of the zones.

The present invention provides, in a fifth aspect, a system for creating a colorant pattern in porous material. The system comprises a sealable vacuum chamber with at least one outlet, and at least one reservoir for providing colorant to the sealable vacuum chamber.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
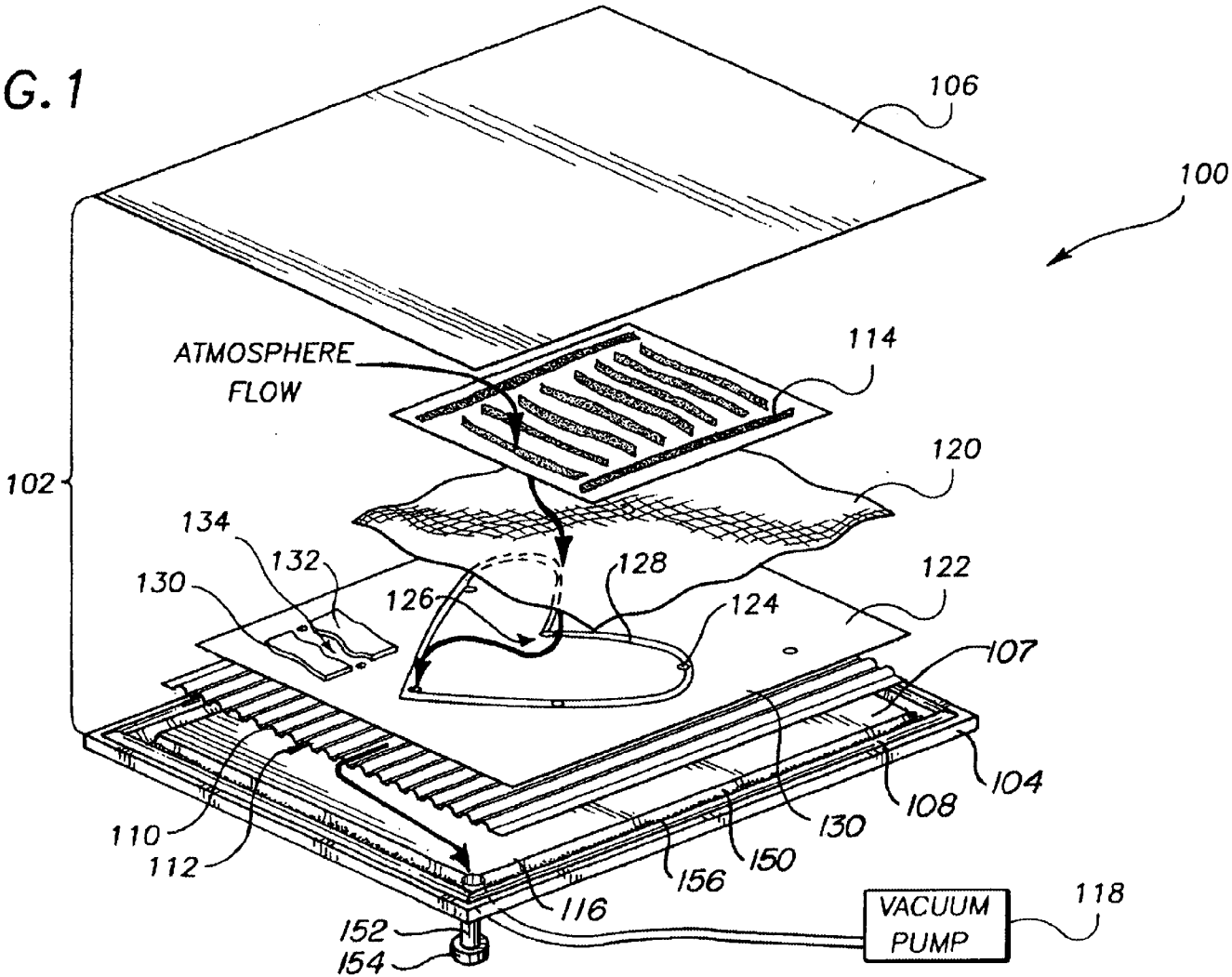
FIG. 1 depicts one example of a system for creating a colorant pattern in porous material, in accordance with the present invention.

FIG. 1 depicts one example of a system 100 for creating a colorant pattern in porous material in accordance with the present invention. System 100 comprises a sealable vacuum chamber 102 including, for example, a base 104, non-conforming sealing membrane 106, conforming rubber blanket 107, and gasket (i.e., perimeter seal) 108. The sealable vacuum chamber can take many forms, such as, for example, a conventional vacuum table. System 100 also comprises a raised layer 110 providing vacuum flow channels (e.g., channel 112) for exiting of colorant 114 as described below. The vacuum is created by vacuum pump 118 drawing atmosphere through at least one opening 116, and when in operation, sealing membrane 106 and gasket 108 create the seal for the vacuum chamber.

In the present example, colorant 114 is situated above porous material 120, which can be any porous material lending itself to colorant patterning, for example, fabric. Colorant 114 comprises, for example, any fluid or semi-fluid with dissolved or suspended color particles. As used herein, the term "colorant" comprises one color, a plurality of different colors, multiple shades of the same color, or any combination thereof. Of course, the colorant(s) chosen and the viscosity thereof will depend on the particular application, for example, the type of porous material being patterned and the desired patterning effect. A template 122 comprises a plurality of openings (e.g., openings 124 and 126) between which is a flow guide 128 for guiding colorant across and into porous material 120. Template 122 can comprise any number of materials (e.g., plastic, metal, etc.), so long as it is stiff enough so as not to be conforming under vacuum. The template is easily modified and inexpensive, relative to screens, thereby providing a cost advantage. The flow guide(s) can be arranged in any design, for example, the heart design shown in FIG. 1. A flow guide can take any number of forms, so long as it serves the purpose of guiding colorant across the porous material. The flow guide also helps ensure that most or all of the colorant is absorbed by the porous material, in order to significantly reduce or eliminate puddling of colorant. Preferably, the flow guide also allows for at least slight variations in successive patterns created without altering the flow guide itself. This is due to the use of a vacuum and the inherent randomness associated therewith. Each of the example flow guides below allows for such variations.

For example, the flow guide can take the form of a channel within or on (see FIG. 1) the surface of template 122. Where the channel is within the template, it simply acts as a canal between openings. As another example, the flow guide can take the form of a wire (e.g., wire 160) on the template strung between two points, for example, between two openings (in this example, openings 162 and 164). As another example, the flow guide can simply be one or more openings in the template (e.g., opening 166). In conjunction with vacuum pump 118, and depending on the location of at least some of the colorant other than directly above the opening(s), the opening(s) serve to pull the colorant across the porous material and toward the opening(s). As still another example, the flow guide can take the form of at least two barriers (e.g., barriers 130 and 132) on the template, spaced apart such that a channel 134 is created between them. As yet a further example, the flow guide can take the form of at least one capillary, tube or other conduit on the template with a plurality of openings along a length thereof (see FIG. 3 and the description thereof). Of course, through-openings in the template are not necessary for the operation of system 100. However, the openings assist in exhausting the colorant to the porous material, helping to significantly reduce or eliminate puddling of the colorant. Where no openings are included in the template (e.g., in a situation where the porous material being patterned is relatively small), the colorant would simply flow, when under vacuum, toward a nearest edge (e.g., edge 129) to a channel in raised area 110 and toward opening 116, for example. Of course, there will be a size limit when no openings in the template are used where edge flow will result in insufficient "drainage" causing, for example, puddling of colorant.

FIG. 1 also depicts one example of an excess colorant collector 150 in the form of a trough between conforming rubber blanket 107 and gasket 108 around base 104. The trough is pitched such that colorant 156 therein will flow toward an outlet 152, which is generally covered with a cap 154 until draining of the colorant is required. As shown, opening 116 to vacuum pump 118 is placed above the trough to reduce the likelihood of colorant entering the pump. Of course, a trough is merely one example of an excess colorant collector. As another example, described in detail with respect to FIG. 2, the excess colorant collector could take the form of a collection trap couplable to the vacuum outlet(s) (here, opening 116).

It will be understood that non-conforming sealing membrane 106 is stiff enough so as to prevent conformal covering of that which lies beneath it when a vacuum is applied. In the past, conforming bladders providing even pressure, for example, were purposely used to help force ink through a stencil opening and through the fabric underneath. However, such conforming bladders may actually interfere with the flowing of colorant across the porous material in the present invention, due to the even pressure.

Figure 2:
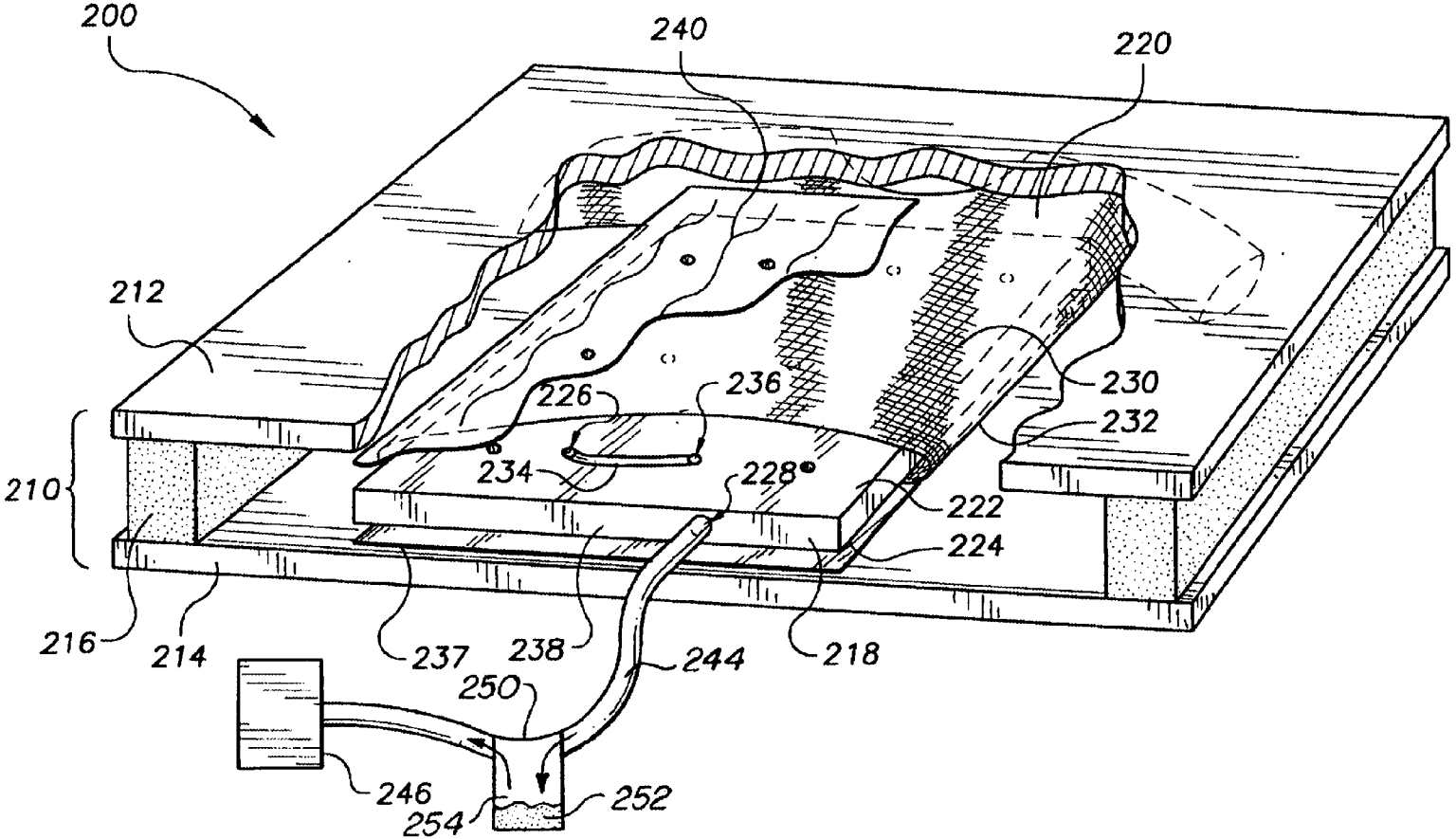
FIG. 2 depicts another example of a system in accordance with the present invention featuring a hollow template.

FIG. 2 depicts another example of a system 200 for creating a colorant pattern in porous material, in accordance with the present invention. A sealable vacuum chamber 210 comprises a non-confirming sealing membrane 212 and base 214, similar to that in FIG. 1, except that the seal comprises a compressible seal 216 made of, for example, rubber around a periphery of the chamber. In addition, the base 214 must be non-conforming where both sides of the hollow template are used for pattern creation. As with the system of FIG. 1, a seal is achieved by the application of the vacuum, resulting in a pressure differential.

A hollow template 218 is shown placed inside a shirt 220. There are openings on the top 222 and bottom 224 of the template (e.g., openings 226 and 236 on the top, with similar openings on the bottom). Each of the top and bottom of the template serves the same purpose as template 122 from FIG. 1, relative to each of a front side 230 and a back side 232 of shirt 220, respectively. For example, a flow guide 234 can be placed between openings 226 and 236. Where there are openings on both the top and bottom of the hollow template, the sides (e.g., side 238) are preferably closed off. In such a situation, colorant from a colorant layer 240, shown partially in FIG. 2 for simplicity, would be pulled down by a vacuum through front 230, along flow guide 234 and into opening 226 and/or 236. Similarly, colorant from a bottom colorant layer 237 would be pulled up through the back side 232, and along flow guides and through openings (not shown) on bottom 224 of the template similar to top 222. Flow guides on the outer face of both top 222 and bottom 224 allow pattern creation on both front side 230 and back side 232 of shirt 220. For example, a logo could be printed on the front side and reversed on the back side. The vacuum for system 200 is achieved with, for example, a vacuum pump 246 pulling atmosphere through opening 228 via conduit 244. Unlike the system of FIG. 1, system 200 does not include a raised layer, due to the hollow nature of the template. Further, it will be understood that hollow template 218 need not lie horizontal in a vacuum chamber; it could also be situated vertically to enhance drainage of excess colorant.

One example of an excess colorant collector 250 is also depicted in FIG. 2 in the form of a collection trap coupled to conduit 244. A combination of colorant 252 and atmosphere 254 enter the collection trap where the colorant falls by gravity to the bottom, while the atmosphere continues back out conduit 244 toward vacuum pump 246.

Figure 3:
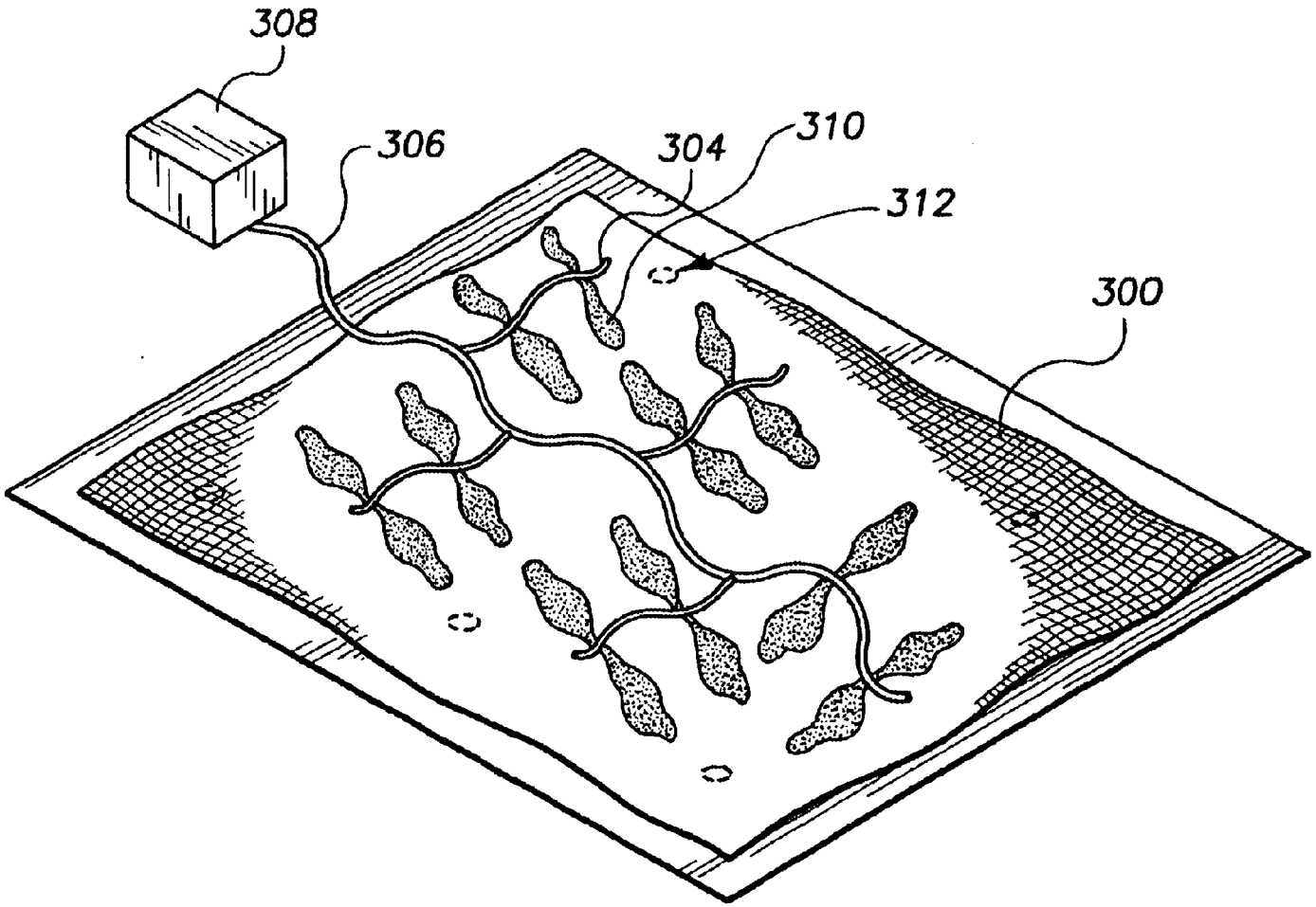
FIG. 3 depicts a portion of the system of FIG. 1 with an external colorant feed.

FIG. 3 depicts one example of a conduit-type flow guide mentioned above with respect to FIG. 1. Shown in FIG. 3 is porous material 300 atop a template 302 that can be used with sealable vacuum chamber 102 from FIG. 1. At least one conduit (e.g., conduit 304) lies on top of the porous material, and is connected to a colorant feed 306. Colorant feed 306, in turn, is connected to a colorant reservoir 308. Colorant reservoir 308 can be flexible or rigid, open or sealed. Further, the reservoir can be valved to control dispensing. Each conduit comprises a plurality of openings along its length for the colorant 310 to exit, when under vacuum, onto porous material 300 and move thereacross and into toward a nearest opening (e.g., opening 312 shown in phantom) in the template. The vacuum provides the draw for colorant 310, such that a separate pump is not typically necessary. The capillaries are sized to achieve the desired transport of colorant based on, for example, the viscosity thereof. In the embodiment shown in FIG. 3, the colorant feed and reservoir are external to the sealable vacuum chamber (not show in FIG.3 for simplicity). However, the colorant feed and reservoir could also be internal to the sealable vacuum chamber, for example, if the colorant reservoir took the form of a collapsible bladder.

Figure 5:
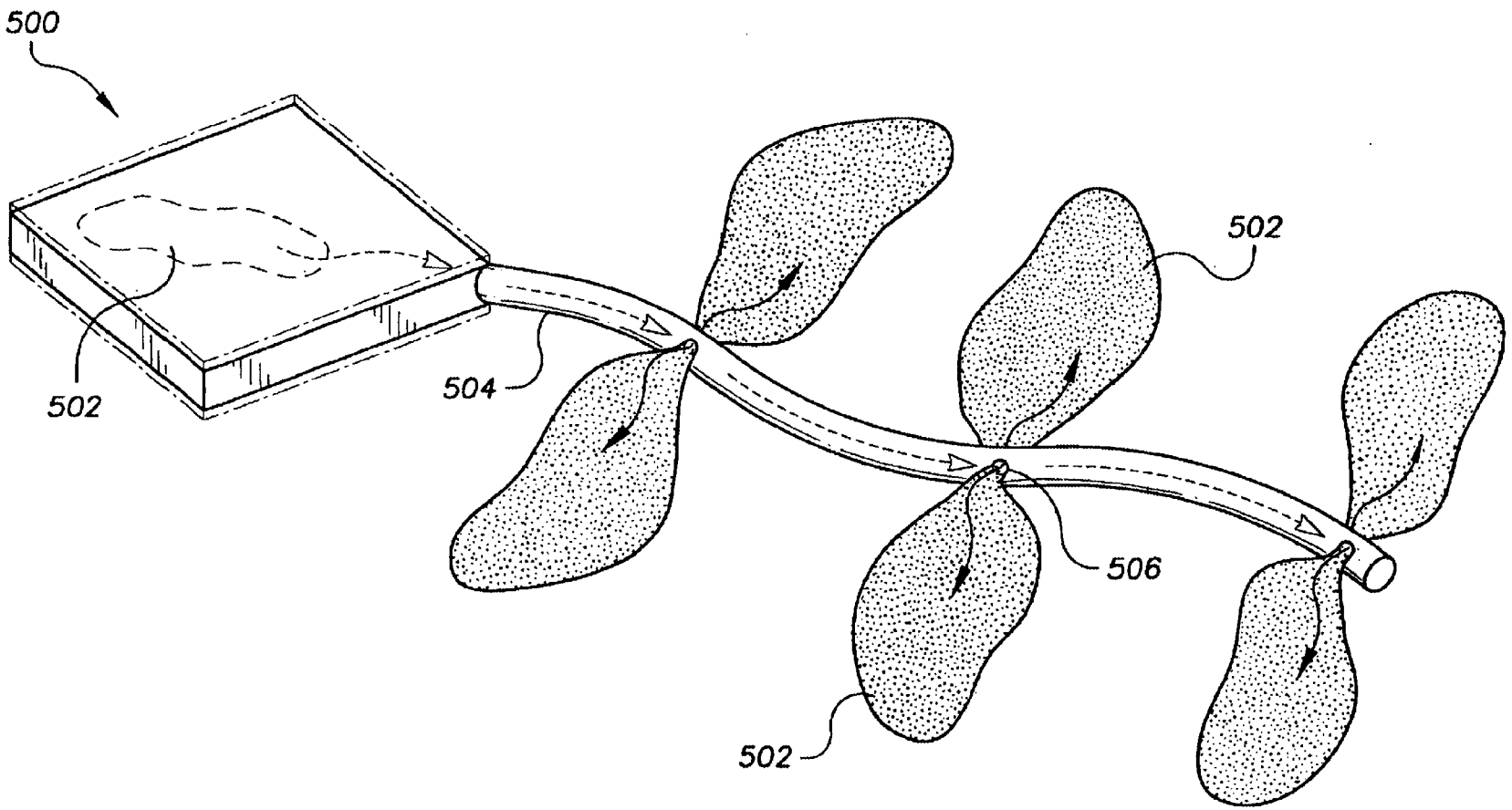
FIG. 5 depicts one example of a collapsing bladder useful with the present invention.

FIG. 5 depicts one example of a collapsible bladder 500. Bladder 500 can comprise any number of flexible, non-absorbent materials, for example, plastic or vinyl. Colorant 502 is held within bladder 500 until some force, either direct or indirect (here, the vacuum), in effect squeezes bladder 500. Colorant 502 then flows out of bladder 500 into one or more capillaries or tubes 504 with a plurality of openings therein (e.g., opening 506) through which colorant 502 exits onto and into porous material (not shown).

Figure 4:
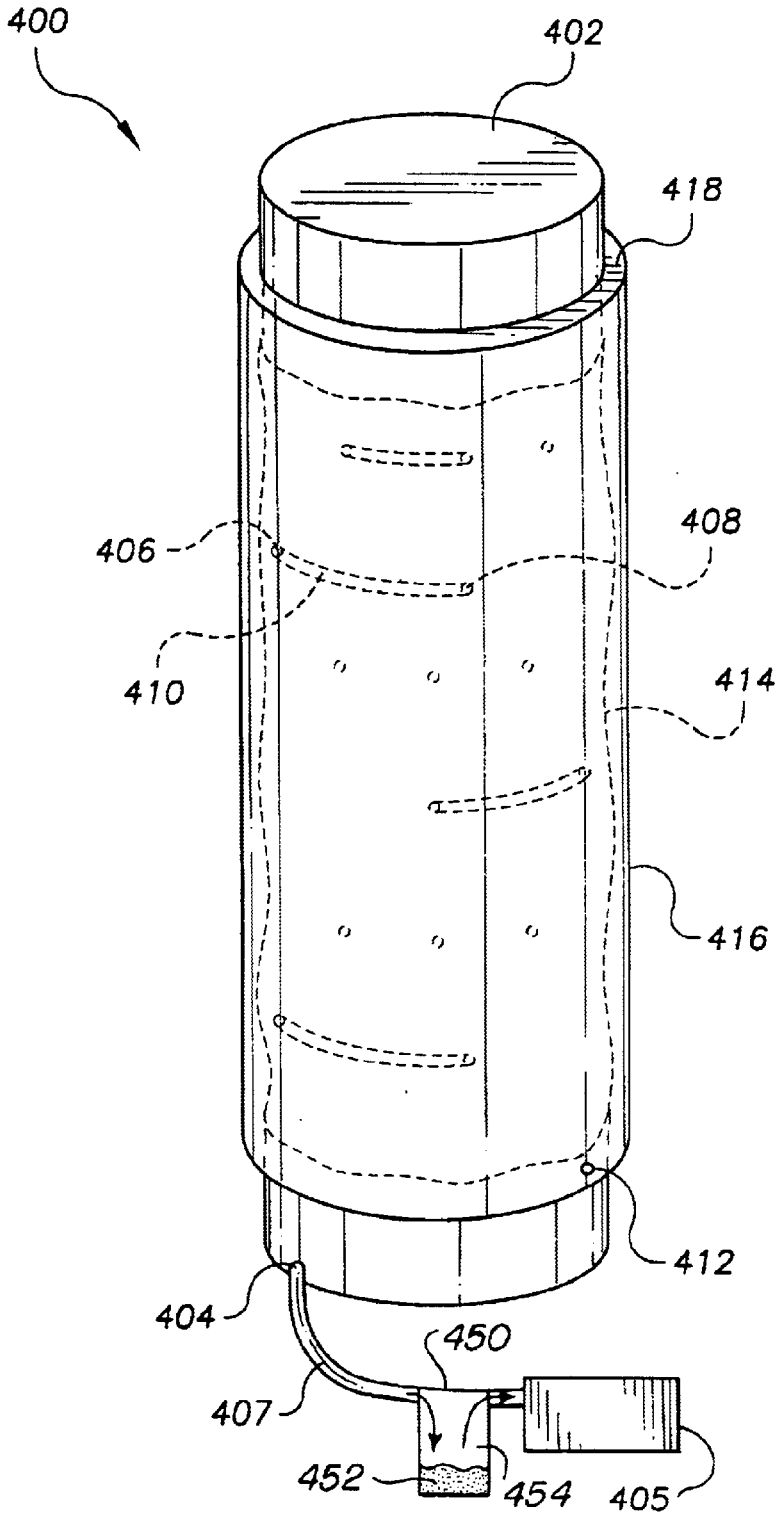
FIG. 4 depicts another example of a system in accordance with the present invention.

FIG. 4 depicts another embodiment of a system 400 in accordance with the present invention. System 400 comprises a cylindrical vacuum manifold 402 with at least one vacuum outlet 404 to a vacuum pump 405 through conduit 407. A plurality of openings are shown in phantom (e.g., openings 406 and 408) leading to vacuum outlet 404 through passages (not shown) internal to cylindrical vacuum manifold 402. Manifold 402 is made of any number of stiff materials, for example, metal, plastic, etc. As with the other embodiments, colorant flow guides (e.g., flow guide 410) are provided between the openings. Thus, the manifold serves the same functions as both base 104 and template 122 in the embodiment of FIG. 1. Also, it will be understood that no openings need connect the flow guides. Colorant could simply move under vacuum across the guides and toward an opening (e.g., opening 412) not covered by porous material 414. The colorant flow guides can take all the forms mentioned previously with respect to FIG. 1. Also shown in FIG. 4 is a non-conforming sealing girdle 416 that can seal to vacuum manifold 402 by, for example, a compressible seal 418 similar to that described with respect to FIG. 2. The non-conforming sealing girdle can be made of any number of stiff materials, for example, metal, plastic, etc. One example of an excess colorant collector 450 is shown in FIG. 4 in the form of a collection trap, similar to that shown and described with respect to FIG. 2. Excess colorant 452 is trapped in the collection trap, while atmosphere 454 passes through to vacuum pump 405.

Figure 6:
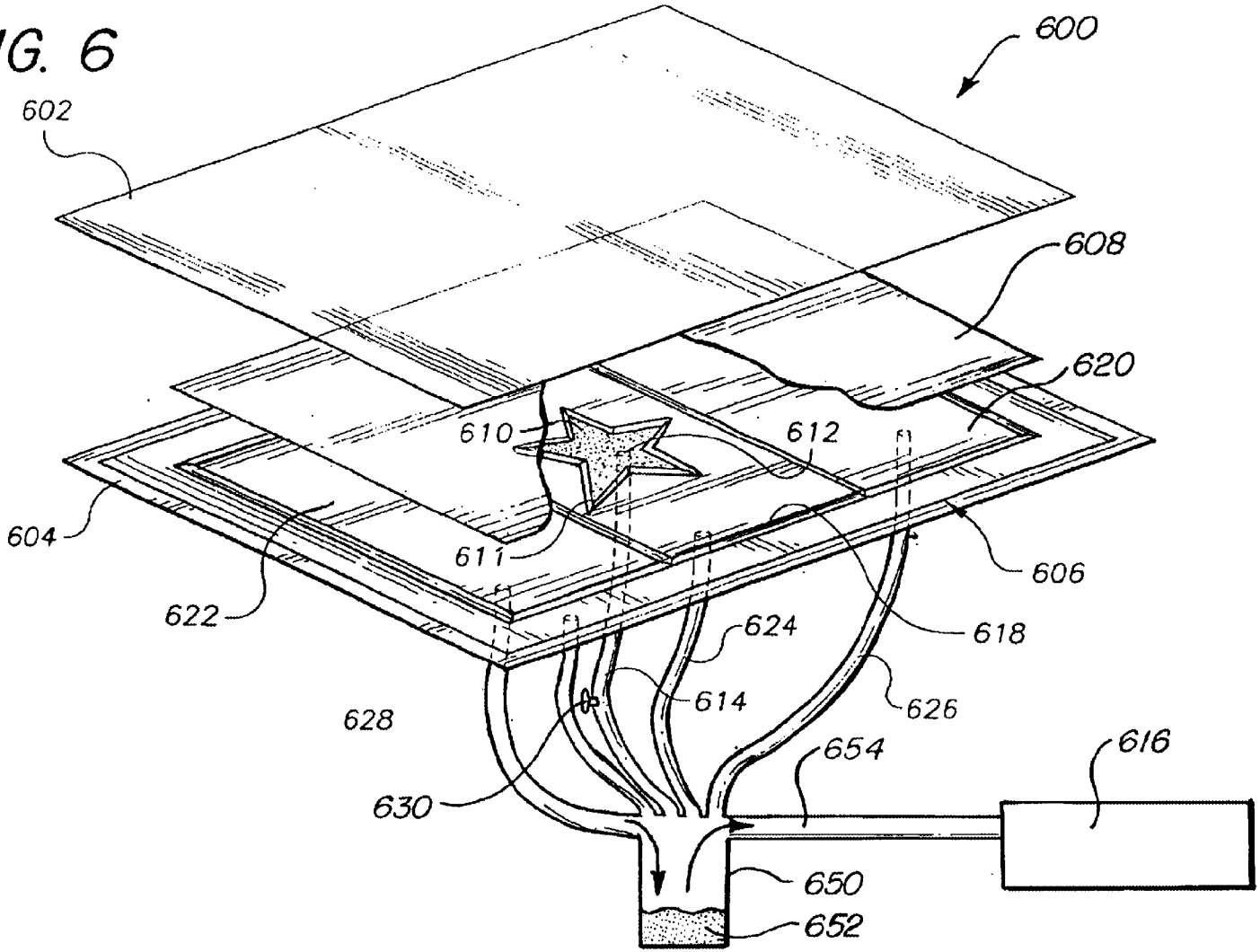
FIG. 6 depicts another example of a system for creating a colorant pattern in porous material, in accordance with the present invention.

FIG. 6 depicts another example of the present invention. System 600 comprises a top non-conforming sealing membrane 602 and a corresponding bottom non-conforming sealing membrane 604, together comprising a sealable vacuum chamber. Both membranes are similar to membrane 106 in FIG. 1, with the bottom membrane serving the functions of both base 104 and template 122 in system 100. The top membrane is sized identical to the bottom membrane. System 600 further comprises a perimeter barrier gasket 606, similar to weather stripping, that prevents colorant (not shown for convenience) from potentially seeping out. The same type of gasket material is used below porous material 608 to create areas or zones where colorant can be guided separately from other zones. Of course, the gasket material could alternatively be placed on the porous material itself This allows a greater degree of flexibility in design when necessary, as compared to the previous embodiments. The gasket material can be placed passively on the porous material, to be held in place by compression under vacuum, or it can be temporarily adhered to the porous material or template with a non-permanent adhesive, for example.

Zone 610 is shown in FIG. 6 as having a star shape, and is coupled, via opening 612 in bottom non-conforming sealing membrane 604 and conduit 614 ultimately to vacuum pump 616. Zone 610 is created with a barrier gasket 611 like gasket 606. Similarly, each of the other zones 618, 620 and 622 are coupled to the vacuum source by conduits 624, 626 and 628, respectively. Atmosphere through each of the conduits is independently controlled. For example, the atmosphere could be controlled by valves coupled to the conduits (e.g., valve 630). The valves could be controlled manually, or even by computer. Alternatively, each zone could have its own vacuum source controlled independently.

One example of an excess colorant collector 650 is shown in FIG. 6, taking the form of a common collection trap for excess colorant 652 interposed between the various conduits (e.g., conduit 614) mentioned above with respect to the various zones and another conduit 654 coupled to pump 616. Of course, as another example, the conduits from the various zones could also be commonly coupled to the air pump and each have their own collection trap.

Since bottom non-conforming sealing membrane 604 also serves as the template in this embodiment, it will be understood that one or more flow guides as described above with respect to FIG. 1 could be included so as to correspond to one or more zones. This would allow a pattern to be created in a particular zone. Where no flow guides are included for a given zone, the pattern could be allowed to be random, or colorant could saturate the entire zone (e.g., the star zone 610 in FIG. 6), or the zone could have a complete absence of colorant. Where an absence of colorant is intended for a given zone, there need be no vacuum established for that zone.

Figure 7:
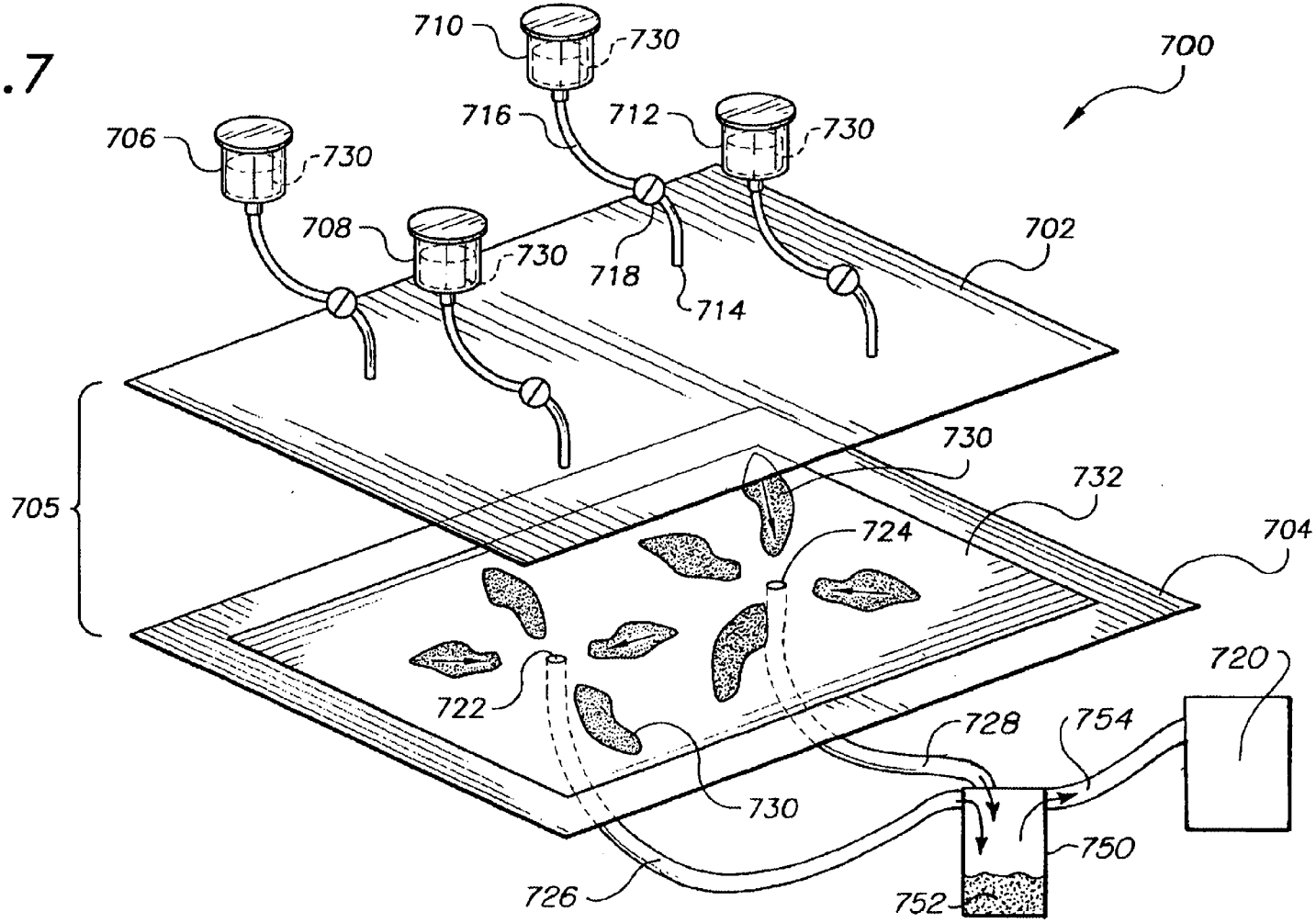
FIG. 7 depicts still another example of a system for creating a colorant pattern in porous material, in accordance with the present invention.

FIG. 7 depicts still another example of a system 700 in accordance with the present invention. Like system 600 in FIG. 6, system 700 comprises a top nonconforming sealing membrane 702 and a corresponding bottom non-conforming sealing membrane 704, together comprising a sealable vacuum chamber 705. As with system 600, bottom membrane 704 serves as both a base and template. Bottom membrane 704 includes one or more flow guides as described herein. Although not shown in FIG. 7, it will be understood that the gasket material described with respect to FIG. 6 could also be used to create zones in porous material patterned with system 700. Another alternative is to have no flow guides or gasket material. Of course, a single reservoir could be used, or less or more reservoirs than shown in FIG. 7. Each reservoir is coupled to an opening in top membrane 702 via conduits, for example, reservoir 710 is coupled to opening 714 via tubing 716. In addition, valves (e.g., valve 718) are preferably included (here, on the conduits) to regulate the amount of colorant entering the sealable vacuum chamber.

In operation, a vacuum pump 720 is coupled to outlets 722 and 724 in bottom membrane 704 via conduits 726 and 728, respectively. When activated, and when the reservoir valves are opened, the vacuum pump pulls atmosphere through the conduits to cause colorant 730 entering the vacuum chamber to move across and into porous material 732 toward outlets 722 and 724, in accordance with the flow guides on bottom membrane 704. Where the gasket material is used, zones would be created in porous material 732, as described with FIG. 6. Of course, a separate template could also be used, rather than the combination bottom membrane and template described with respect to FIG. 7. System 700 further comprises an excess colorant collector 750 in the form of a common collection trap for colorant 752 coupled to vacuum pump 720 via conduit 754, similar to that of FIG. 6.

The present invention, as described above, provides a relatively low-cost way to produce colorant patterns in porous material with at least slightly varying design in volume. In addition, the penetration of the colorant, at least in fabric, is such that the pattern produced is clear on both the front and back of the fabric with a single application.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. A method of creating a colorant pattern in porous material, comprising:

guiding a colorant in a vacuum environment across and into a porous material to create a colorant pattern therein.

2. The method of claim 1, wherein the guiding comprises:

providing a sealable vacuum chamber with at least one outlet;

placing porous material in the sealable vacuum chamber;

sealing the vacuum chamber; and guiding a colorant across and into the porous material and toward the at least one outlet.

3. A method of claim 2, wherein the guiding comprises providing at least one colorant flow guide.

4. The method of claim 3, further comprising, prior to the sealing, placing a template in contact with the porous material within the sealable vacuum chamber, wherein providing the at least one colorant flow guide comprises providing at least one wire on the template.

5. The method of claim 2, wherein the porous material comprises fabric.

6. The method of claim 2, further comprising applying colorant to a surface of the porous material prior to the sealing.

7. The method of claim 2, wherein the guiding comprises guiding the colorant from a location external to the sealable vacuum chamber.

8. The method of claim 7, wherein the guiding comprises guiding the colorant through an opening in the sealable vacuum chamber.

9. The method of claim 7, wherein the guiding comprises guiding the through at least one conduit situated partially within and partially without the sealable vacuum chamber.

10. The method of claim 2, wherein the guiding comprises guiding the colorant from a collapsible bladder within the sealable vacuum chamber.

11. The method of claim 2, further comprising, prior to the sealing and guiding, placing at least one barrier gasket on the porous material to create at least one zone for containing the colorant.

12. The method of claim 11, wherein the at least one zone comprises at least two zones, wherein the at least one outlet comprises a separate outlet for each of the at least one zone, and wherein the guiding comprises separately controlling a vacuum to each zone.

13. The method of claim 2, further comprising collecting excess colorant not absorbed in the porous material.

14. The method of claim 1, further comprising repeating the guiding for another porous material, wherein a pattern created in the another porous material varies at least slightly from the pattern created in the porous material.

15. The method of claim 3, wherein providing at least one colorant flow guide comprises providing a template with at least one opening therein, the method further comprising, prior to the sealing, placing the template in contact with the porous material within the sealable vacuum chamber.

16. A method of creating a colorant pattern in porous material, comprising:

guiding a colorant in a vacuum environment across and into a porous material to create a colorant pattern therein, comprising:

providing a sealable vacuum chamber with at least one outlet;

placing porous material in the sealable vacuum chamber;

sealing the vacuum chamber;

prior to the sealing, placing, a template in contact with the porous material within the scalable vacuum chamber; and guiding a colorant across and into the porous material and toward the at least one outlet, comprising providing at least one colorant flow guide, wherein providing the at least one colorant flow guide comprises providing at least one channel in the template.

17. A method of creating a colorant pattern in porous material, comprising:

guiding a colorant in a vacuum environment across and into a porous material to create a colorant pattern therein, comprising:

providing a sealable vacuum chamber with at least one outlet;

placing porous material in the sealable vacuum chamber;

sealing the vacuum chamber;

prior to the sealing, placing a template in contact with the porous material within the scalable vacuum chamber; and guiding a colorant across and into the porous material and toward the at least one outlet, comprising providing at least one colorant flow guide, wherein providing the at least one colorant flow guide comprises forming at least one channel in the template.

18. The method of claim 17, wherein forming the at least one channel comprises placing a least two barriers on the template spaced apart such that the least one channel is created therebetween.

19. A method of creating a colorant pattern in porous material, comprising:

guiding a colorant in a vacuum environment across and into a porous material to create a colorant pattern therein, comprising:

providing a sealable vacuum chamber with at least one outlet;

placing porous material in the sealable vacuum chamber;

sealing the vacuum chamber;

prior to the sealing, placing a template in contact with the porous material within the scalable vacuum chamber; and guiding a colorant across and into the porous material and toward the at least one outlet, comprising providing at least one colorant flow guide, wherein providing the at least one colorant flow guide comprises providing at least one channel in the template with a plurality of openings along a length thereof.

20. A method of creating a colorant pattern in porous material, comprising:

guiding a colorant in a vacuum environment across and into a porous material to create a colorant pattern therein, comprising:

providing a sealable vacuum chamber with at least one outlet;

placing porous material in the sealable vacuum chamber;

sealing the vacuum chamber;

prior to the sealing, placing a template in contact with the porous material within the sealable vacuum chamber, wherein the template comprises at lease two openings; and guiding a colorant across and into the porous material and toward the at least one outlet, comprising providing at least one colorant flow guide, wherein the at least one colorant flow guide is situated between at least two opening.

21. A method of creating a colorant pattern in porous material, comprising:

a sealable vacuum chamber with at least one outlet;

a template comprising at least one colorant flow guide for guiding a colorant under vacuum across and into porous material and toward the at least one outlet when in contract will the template to create a colorant pattern in the porous material.

22.The system of claim 21, further comprising a vacuum pump couplable to the sealed vacuum chamber for evacuating same.

23. The system of claim 21, wherein the sealable vacuum chamber comprises a sealable vacuum table.

24. The system of claim 21, wherein the at least one colorant flow guide comprises at least one channel in the template.

25. The system of claim 21, wherein the at least one colorant flow guide comprises at least one wire on the template.

26. The system of claim 21, wherein the at least one colorant flow guide comprises at least one channel formed on the template.

27. The system of claim 26, wherein the at least one channel comprises at least two barriers on the template spaced apart such that at least one channel is created therebetween.

28. The system of claim 21, wherein the at least one colorant flow guide comprises at least one conduit with a plurality of openings along a length thereof.

29. The system or claim 21, wherein the template is hollow.

30. The system of claim 29, wherein the template comprises a first face and a second face, and wherein the at least one colorant flow guide comprises a first flow guide on the first face and a second flow guide on the second face.

31. The system of claim 21, wherein the sealable vacuum chamber is cylindrical.

32. The system of claim 21, further comprising a colorant.

33. The system of claim 21, further comprising a colorant feed external to the sealable vacuum chamber.

34. The system of claim 33, wherein the colorant feed is couple to the at least one colorant flow guild.

35. The system of claim 21, further comprising a colorant feed internal to the sealable vacuum chamber.

36. The system of claim 35, wherein the colorant feed is couple to the at least one colorant flow guild.

37. The system of claim 35, wherein the colorant feed comprises a collapsible bladder.

38. The system of claim 21, wherein the template comprises at least two openings, and wherein the at least one colorant flow guide is situated between the at least two openings.

39. The system of claim 21, wherein the at least one colorant flow guide allows for at least a slight variation in consecutive pattern created.

40. The system of claim 21, further comprising a colorant an excess colorant collector.

41. The system of claim 40, wherein the excess colorant collector comprises a trough below the at least one outlet.

42. The system of claim 40, wherein the excess colorant collector comprises a collection trap couplable to the at least one outlet.

43. Apparatus for creating a colorant pattern in porous material, comprising:

a template with at least one colorant flow guide for guiding colorant along the flow guide when under vacuum, wherein the at least one colorant flow guide comprises at least one wire on the template.

44. Apparatus for creating a colorant pattern in porous material, comprising a template and at least one colorant flow guide for guiding colorant along the flow guide when under vacuum, wherein the at least one colorant flow guide comprises at least one conduit separate from the template with a plurality of openings along a length thereof.

45. The Apparatus for creating a colorant pattern in porous material, comprising:

a template with at least one colorant flow guide for guiding colorant along the flow guide when under vacuum, wherein the template comprises at least two openings, and wherein the least one colorant flow guide is situated between the at least two openings.

46. Apparatus for creating a colorant pattern in porous material, comprising a template with at least one opening therein for guiding colorant flow guide under vacuum across porous material toward the at least one opening.

* * * * *

UNITED STATES PATENT AND TRADEMARK OFFICE

CERTIFICATE OF CORRECTION

PATENT NO. : 6,655,271 B1
DATED : December 2, 2003
INVENTOR(S) : Contompasis

It is certified that error appears in the above-identified patent and that said Letters Patent is hereby corrected as shown below:

Column 8,
Line 52, delete the word “channel in” and insert -- conduit on --

Column 9,
Line 5, delete the word “opening” and insert -- openings --
Line 6, delete the word “method” and insert -- system --

Column 10,
Line 4, delete the word “guild” and insert -- guide --
Line 13, delete the word “pattern” and insert -- patterns --
Line 14, delete the words “a colorant”
Line 44, delete the words “flow guide” and insert -- when --

Signed and Sealed this

Sixth Day of April, 2004

JON W. DUDAS
*Acting Director of the United States Patent and Trademark Office*